US007363731B2

(12) United States Patent
Dana, III

(10) Patent No.: US 7,363,731 B2
(45) Date of Patent: Apr. 29, 2008

(54) SECURITY FOOTWEAR

(76) Inventor: Alfred Dana, III, 2805 E. Oakland Park Blvd. #222, Fort Lauderdale, FL (US) 33306

( * ) Notice: Subject to any disclaimer, the term of this patent is extended or adjusted under 35 U.S.C. 154(b) by 183 days.

(21) Appl. No.: 11/082,511

(22) Filed: Mar. 17, 2005

(65) Prior Publication Data

US 2006/0207124 A1 Sep. 21, 2006

(51) Int. Cl.
*A43B 23/00* (2006.01)

(52) U.S. Cl. ..... 36/1; 36/136

(58) Field of Classification Search ..... 36/1, 36/45, 25 R, 136

See application file for complete search history.

(56) References Cited

U.S. PATENT DOCUMENTS 2,887,792 A 5/1959 Staff
4,766,680 A * 8/1988 Maciel et al. ..... 36/87
5,012,596 A * 5/1991 Schiller ..... 36/11.5
5,461,188 A * 10/1995 Drago et al. ..... 84/600
5,659,979 A * 8/1997 Sileo ..... 36/54
D430,966 S 9/2000 Brady et al.
6,256,824 B1 * 7/2001 Austin et al. ..... 12/142 P
6,568,101 B1 * 5/2003 Jansen et al. ..... 36/7.3
6,739,074 B2 * 5/2004 Trommer ..... 36/1
6,904,706 B2 * 6/2005 Jones et al. ..... 36/11.5
7,059,070 B2 * 6/2006 Omstead et al. ..... 36/137
2005/0188562 A1 * 9/2005 Clarke et al. ..... 36/15
2005/0217150 A1 * 10/2005 Hoffer et al. ..... 36/59 R

* cited by examiner

*Primary Examiner*—Ted Kavanaugh
(74) *Attorney, Agent, or Firm*—Richard M. Saccocio

(57) ABSTRACT

A substantially transparent article of footwear includes a substantially transparent resilient sole having a gripping surface and a substantially transparent shoe upper integrally extending from the resilient sole. The upper includes an element for aeration of a foot of a user and a substantially transparent insole disposed within the upper and a closure element for the upper. The transparent closure element operates to stabilizing an ankle and in-step area of a foot of the user within the footwear.

4 Claims, 5 Drawing Sheets

SECURITY FOOTWEAR

FIELD OF INVENTION

The present invention pertains to a substantially transparent article of footwear.

BACKGROUND OF THE INVENTION

The events of Sep. 11, 2001 have made security an extremely high priority in the U.S. and elsewhere around the world. There has been an increase in the level of security at many airports, federal buildings, law enforcement agencies and other locales which are frequently traveled. Although the Transportation Security Administration ("TSA") does not require a traveler to remove his shoes before entering a walk-through metal detector, TSA screeners encourage travelers to remove them before entering the metal detector as many types of footwear will require additional screening even if the metal detector does not alarm. TSA screeners thus encourage travelers to remove footwear, that is more likely to require additional screening, including, boots, platform shoes (including platform flip-flops), footwear with a thick sole or heel (including athletic shoes), and footwear containing metal (including many dress and construction shoes).

Accordingly, it is desirable at times to have footwear that is easily removable, comfortable, and that will speed the process of screening at airports, federal buildings, law enforcement agencies and other locales which are frequently traveled.

U.S. Pat. No. 5,659,979 to Sileo relates to transparent footwear, the appearance of which can be altered to achieve different aesthetic affects. The tongue and insole of the footwear include non-transparent indicia which can be removed and either reversed or replaced. Also, other transparent footwear that have been considered in the prior art include U.S. Pat. No. 2,887,792 to Staff relating to women's dress shoes and U.S. Pat. No. D430,966 to Brady et al. relating to a clear sole shoe. However, these devices do not satisfactorily consider all issues of convenience, security, removability, and comfort that are addressed herein.

SUMMARY OF THE INVENTION

The present invention is directed to a substantially transparent article of footwear. This article of footwear comprises a substantially transparent resilient sole including a gripping surface and a substantially transparent shoe upper integrally dependent from the resilient sole. The upper includes means for aeration of a foot of a user and a substantially transparent insole disposed within the shoe upper, and a substantially transparent closure means. The transparent closure means includes means for stabilizing an ankle and in-step area of the foot of the user within the article of footwear. Said shoe upper includes a heel portion formed of a flexible clear material and a forward portion of said upper integrally dependent from said heel portion. Said forward portion of the upper preferably comprises a mesh fabric for aeration of the foot of the user. One edge of said stabilizing means further comprises means for elastic engagement of said ankle and in-step area of said foot.

It is an object of the invention to provide a substantially transparent article of footwear that will allow travelers to pass through security detectors at a quicker pace.

It is another object to provide a comfortable and easily removable transparent article of footwear that may also be used when traveling.

It is a further object to provide a transparent article of footwear to provide to travelers confidence in the knowledge that they are traveling more safely.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
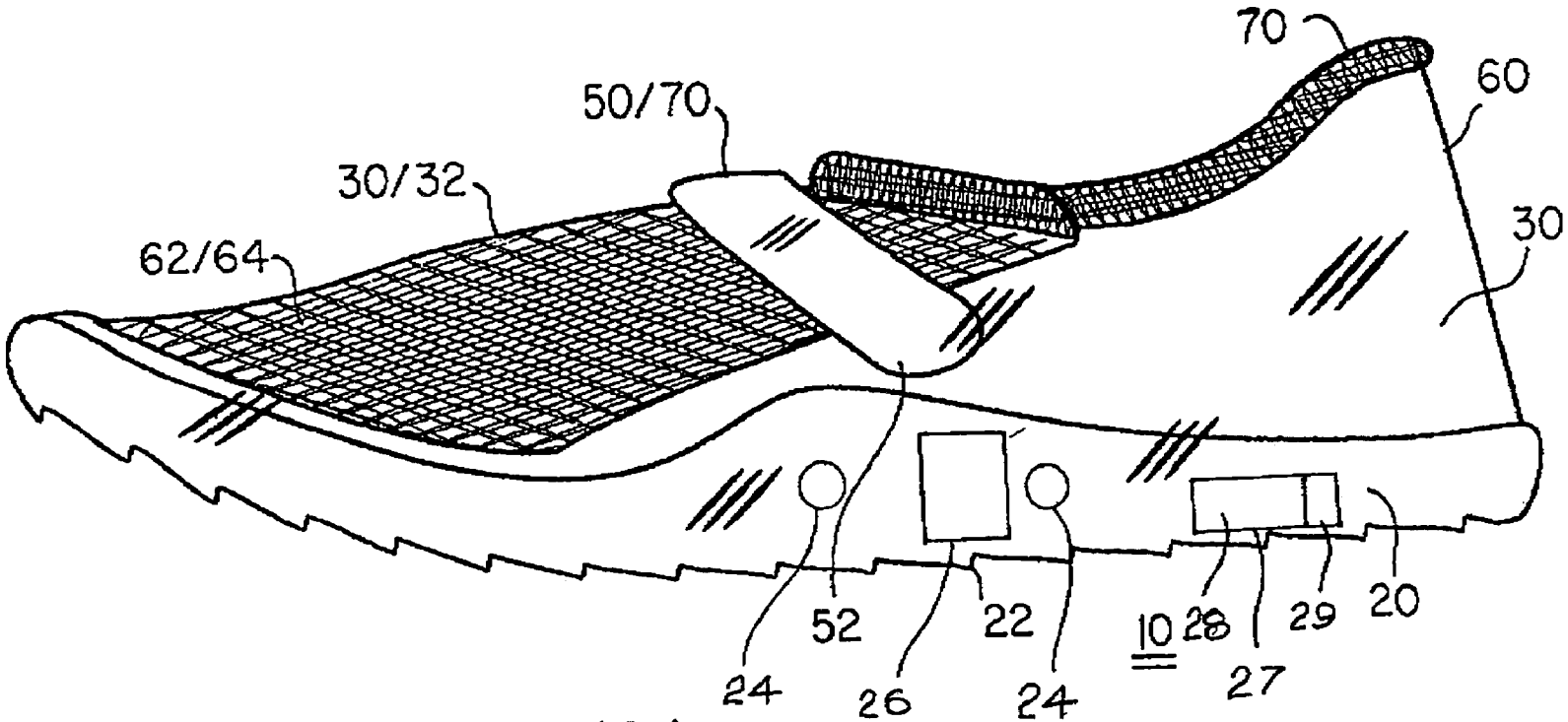
FIG. 1 is a perspective side view of the substantially transparent article of footwear of the present invention.
Figure 2:
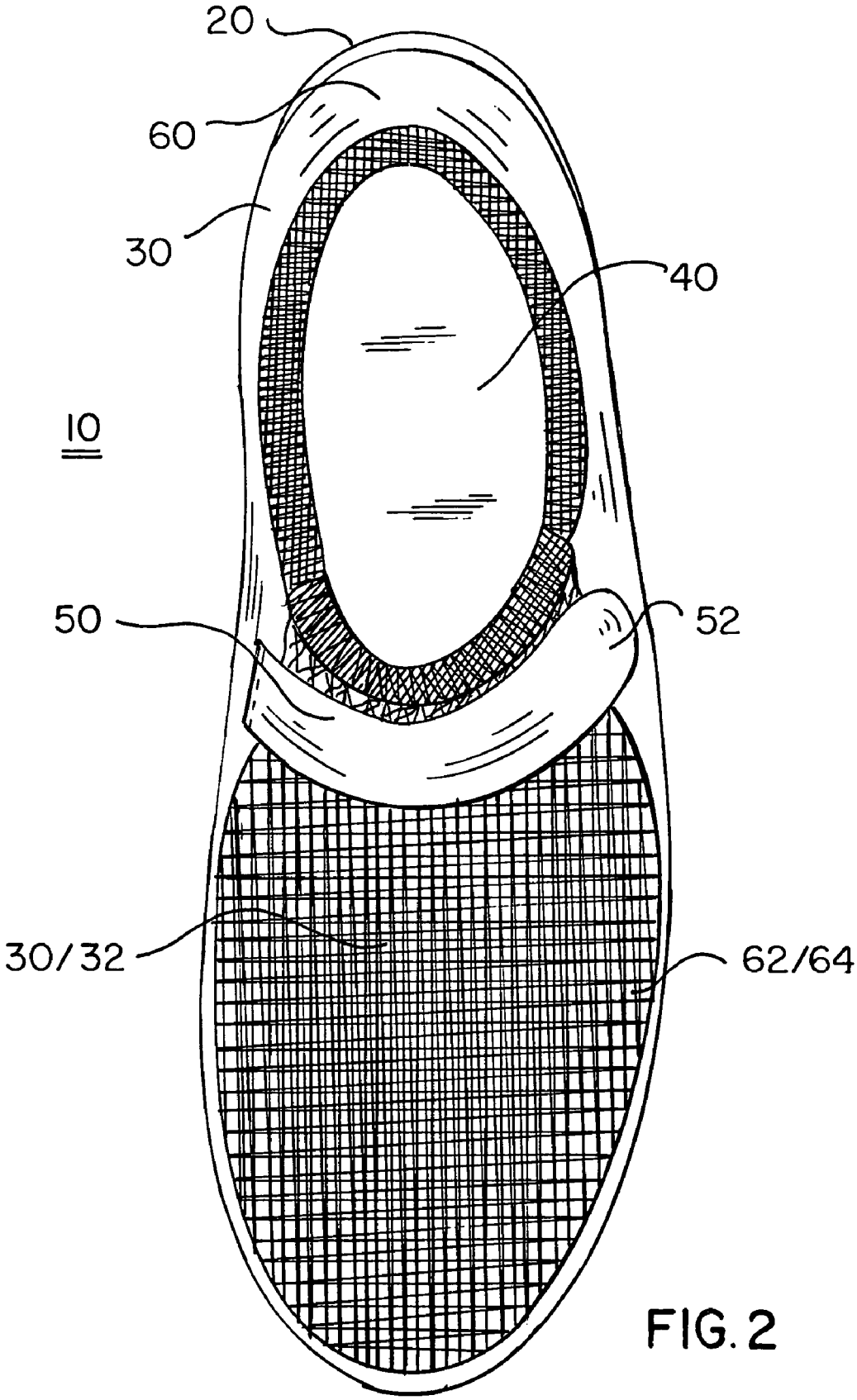
FIG. 2 is a perspective top view of the article of FIG. 1.
Figure 4:
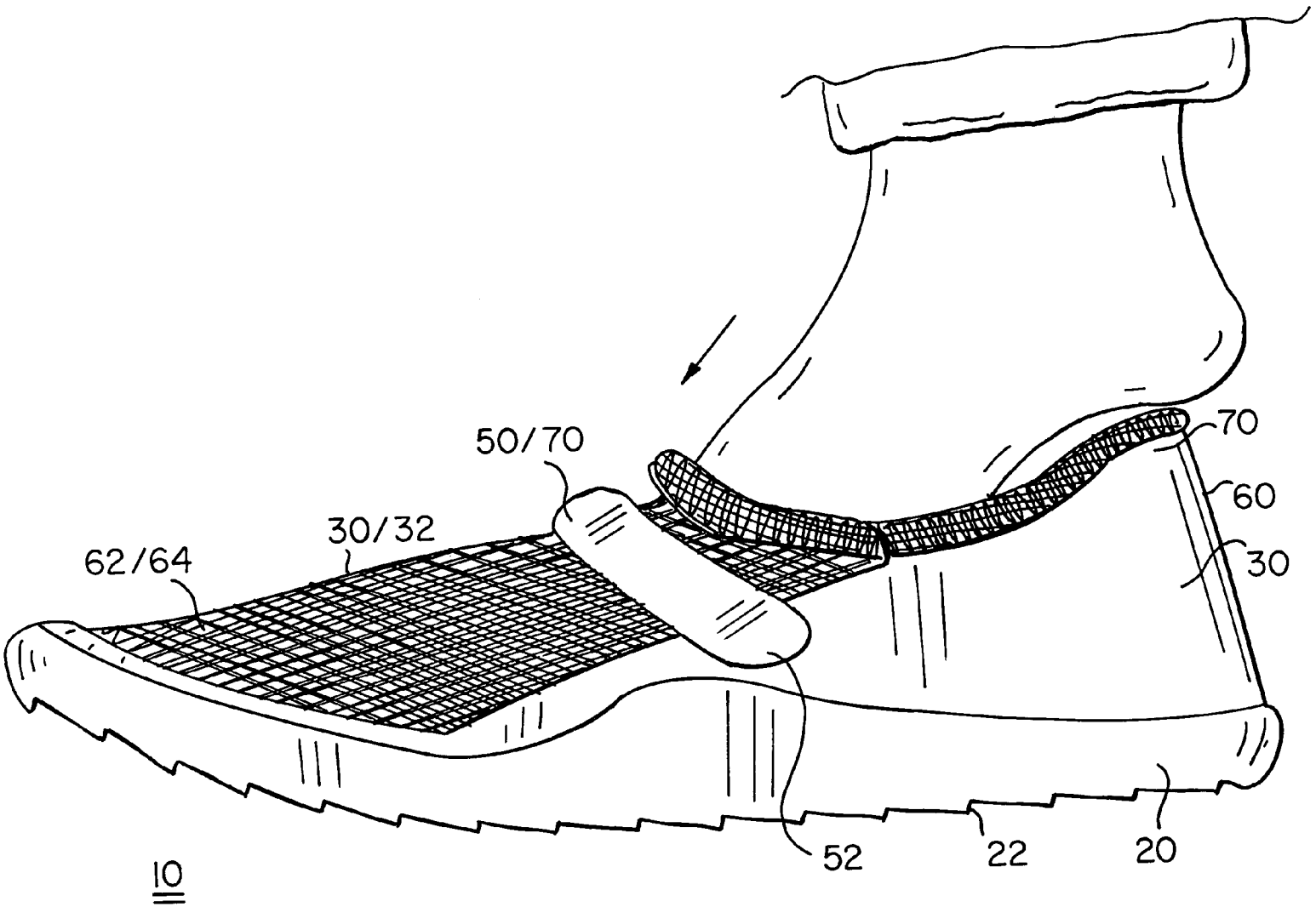
FIG. 4 is an illustrative view showing insertion of the foot of a user into the article of footwear of FIG. 1.

The instant invention relates to an article of footwear 10, as shown in FIGS. 1 and 2. The article of footwear 10 includes a substantially transparent resilient sole 20, a substantially transparent flexible shoe upper 30, a substantially transparent insole 40, and a substantially transparent closure means 50. Said transparent resilient sole 20 includes a gripping surface 22 to improve traction of the article of footwear 10 when worn by a user, as is shown in FIG. 4. The length and width of the transparent sole 20 may vary to accommodate the sizes of a human foot. Said transparent shoe upper 30 is integrally dependent from said substantially transparent sole 20. Such dependence may be accomplished by bonding or integral molding of the elements. As shown in FIG. 1, said shoe upper 30 includes a heel portion 60 formed of a clear but more rigid material than sole 20. Said substantially transparent upper 30 also includes a forward portion 62 which is integrally dependent from said heel portion 60.

Said shoe upper 30 and sole 20 are preferably made of a thermoplastic such as a polyvinyl. Said transparent shoe upper 30 and sole 20 may also be made of other substantially transparent moldable polymers such as polyethylene and polypropylene. It is noted that the majority, the entire article of footwear 10 is formed of one or more substantially transparent materials, materials preferably an elastomeric polymer, but may be made of alternative materials if they are substantially transparent and resilient. However, it may be preferable to manufacture some parts of the article of footwear with non-transparent materials.

The article 10 must be substantially transparent to enable security officers in various locations, including airports to visually inspect the entire shoe and foot of a user to see that no part of the article of footwear 10 includes metal or moving parts, besides those minimal components which are part of the article footwear, for enhanced security purposes discussed below. A security officer is able to accomplish this rapidly so that there will be little need for a traveler to have to remove one's shoes to have them especially scanned.

Said forward portion 62 of shoe upper 30 of said footwear 10 preferably defines a mesh material 64, as shown in FIGS. 1 and 2. Said mesh material 64 comprises means 32 for aeration and expansion of the foot of the user. Preferably, the mesh is made of a substantially transparent elastomeric polymer. The forward portion 62 of shoe upper 30 is not limited to a mesh material and may be a solid transparent material with small ventilation holes integrally placed on the shoe upper 30. The mesh material or an alternative ventilated transparent material 64 allows the foot to breathe within the article of footwear 10. The selection of mesh material 64 can also ensure adequate scanning of the foot of the user in the event a terrorist were to construct the shoe of a radio opaque material. Alternatively, the mesh material may be a solid breathable material as opposed to a material with any type of holes.

Said forward portion 62 of shoe upper 30 of said footwear 10 may also define a mesh material 64 and perforations for aeration. The perforations may also be located on other portions of the article of footwear 10 to allow the foot to breathe.

To assist the user placing the article of footwear on one's foot and preventing of slipping up or down the ankle of the user, one edge of said aeration means 32 may comprise means for elastic engagement 70 of the ankle and in-step area of the foot. Said engagement means may be integrally dependent from the shoe upper 30, as shown in FIGS. 1 and 2 or may comprise a cross-over strap 50 discussed below. Said engagement means may include two or more cross-over straps. Alternatively, said article of footwear may not include said elastic engagement and would be similar to a loafer. Said elastic engagement means 70 preferably comprises a substantially transparent material, which may include an elastomeric polymer.

Figure 3:
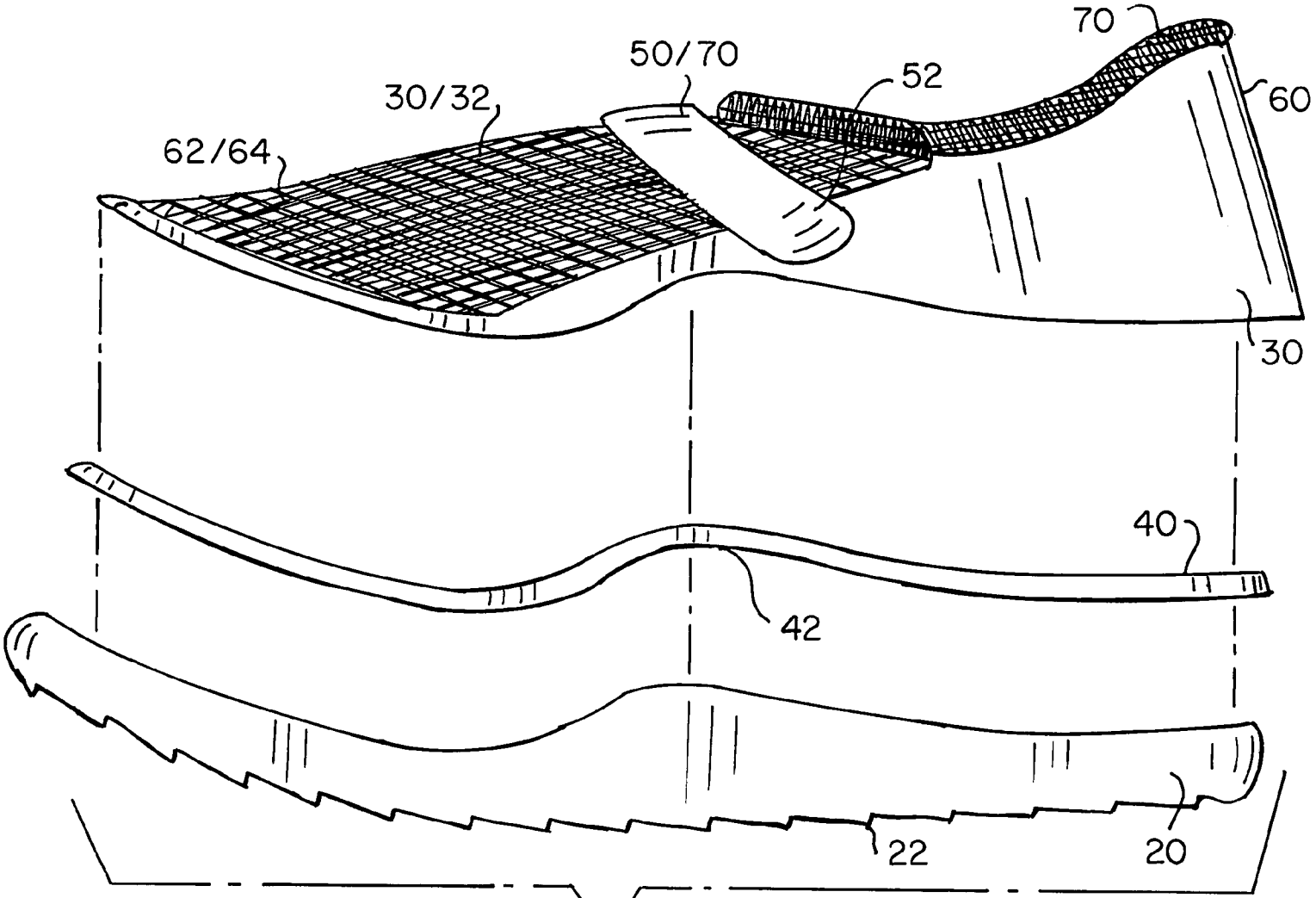
FIG. 3 is a perspective, exploded view of the substantially transparent article of footwear of FIG. 1.

As shown in FIGS. 2 and 3, the article of footwear 10 includes a substantially transparent insole 40. In one embodiment of the present invention, the insole may incorporate an arch system 42 to make the article of footwear 10 more comfortable for the user, which may be seen in FIG. 3.

The article of footwear includes said substantially transparent closure means 50. Said closure means may be a transparent cross-over strap 50 along with a means 52 for stabilizing the ankle of the foot in the article of footwear 10. Said closure means may comprise two or more cross-over straps. Preferably, said cross-over strap 50 is made of hook and loop means such as Velcro® disposed on said cross-over strap 50, which can be adjusted to fit the size of the user's foot and area 54 of said upper. Said stabilizing means may also include snap closures disposed on the cross-over strap 50, or may comprise any of a variety of closure methods, not limited to Velcro® or snap closures. The substantially transparent cross-over strap 50 may also be located across the in-step of the foot or higher up on the ankle of the user. The location of the transparent cross-over strap can be adjusted in accordance the users needs. For example, one user may prefer a low boot style of shoe as opposed to a slipper, hence the higher location of the cross-over strap 50. Some users may prefer a high boot style, which would require two or three cross-over straps. Other users may prefer or need more support across the in-step of the foot, which would require that the cross-over strap be placed across the in-step of the foot. Further, the user may prefer to have a simple slip-on disposable type shoe that may have no stabilizing means.

Figure 5:
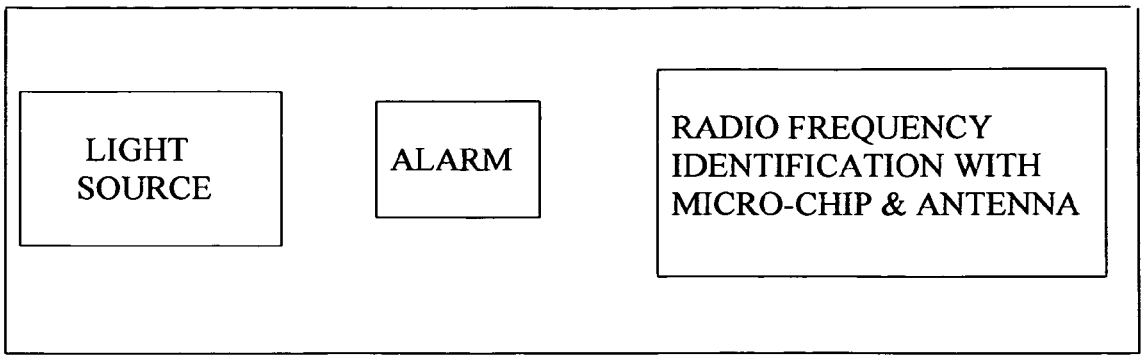
FIG. 5 is diagram showing the components of the shoe sole.

In addition to the substantial transparency of the article of footwear 10, further security of the article 10 may include light sources in one or both shoes, such as LED's, embedded in the substantially transparent sole 20. The light sources can be mounted in the resilient sole 20 such that light emitted from the light sources is visible exteriorly. FIG. 5 shows the components embedded in the sole. Such light sources can be any color and used to assist security officers to detect travelers who have passed through security, but have set off the scanning device, which in turn, would activate the LED's.

The article of footwear 10 may also include an e-m actuatable audible alarm embedded in the resilient sole 20 of one or both shoes. Such an audible alarm would be heard by security officers who may have let travelers through security, but have then set off the scanning device.

The article of footwear 10 may also include a breakable security seal embedded in the substantially transparent shoe upper or heel in one or both shoes. The security seal would prevent tampering with the article of footwear and could be seen by security officers in the event the seal in the article of footwear had been tampered with.

For further security purposes, the article of footwear 10 may include a radio frequency identification in one or both shoes, or RFID, a generic term for technologies that use radio waves to automatically identify people or objects. There are several methods of identification, but the most common is to store a serial number that identifies a person or object, and perhaps other information, on a microchip that is attached to an antenna (the chip and the antenna together are called an RFID transponder or an RFID tag). The antenna enables the chip to transmit the identification information to a reader. The reader converts the radio waves reflected back from the RFID tag into digital information that can then be passed on to computers that can analyze it. The chip may be embedded in the sole 20 or other part of the shoe to allow transmission of the identification information, which may incorporate the use of radio telemetry, such as GPS.

The LED's, audible alarm and RFID chip, as well as any other incorporated electronic components of the article may be recharged by piezoelectricity resulting from the application of mechanical pressure on a dielectric crystal. The components may also be recharged by method of solar, emotion charging, or charged electrically through an A/C adapter.

When in use, the user places the article of footwear on one's foot at any time prior to passing through security at an airport or other location with secured entrances. Because of the gripping surface 22 on the sole 20 the article of footwear can be worn outdoors as well as indoors. The user may prefer to place the article of footwear 10 on one's feet just prior to entering an airport or building.

The article of footwear may be manufactured and/or sold with a companion, substantially transparent tote bag for the user to place their civilian shoes in while wearing the transparent article of footwear. The companion substantially transparent tote bag may be manufactured with a Ziploc® hook-and-loop type of closure. The companion substantially transparent tote bag may also include a strap closure so that a person cannot add or subtract anything from the tote bag upon reaching security. Similar to the breakable security seal that may be embedded in the article of footwear 10, the tote bag may also contain a similar seal which may be visually inspected by security officers to see if the tote bag has been tampered with. For further security the companion substantially transparent tote bag may incorporate similar electronics as the article of footwear 10, such as the LED's, RFID chip, or audible alarm.

While there has been shown and described the preferred embodiment of the instant invention it is to be appreciated that the invention may be embodied otherwise than is herein specifically shown and described and that, within said embodiment, certain changes may be made in the form without departing from the underlying ideas or principles of this invention as set forth in the Claims appended herewith.

What is claimed is:

1. An article of footwear adapted for purposes of security comprising a substantially transparent sole, a substantially transparent shoe upper, one or more light sources mounted in said footwear that can be seen exteriorly of said footwear, radio frequency identification means disposed in said footwear whereby said one or more light sources are activated by a security scanning device when said security scanning device detects a metal object.

2. An article of footwear adapted for purposes of security comprising a substantially transparent sole, a substantially transparent shoe upper, an alarm mounted in said sole, whereby said alarm is activated by a security scanning device when said security scanning device detects a metal object.

3. An article of footwear adapted for purposes of security comprising a substantially transparent sole, a substantially transparent shoe upper, radio frequency identification means disposed in said footwear, comprising a radio frequency identification means disposed in said footwear microchip and attached antenna, whereby said microchip and attached antenna transmit identification information of a wearer of said article of footwear and is received by other than the wearer of the footwear.

4. The article of footwear of claim 3 including radio telemetry apparatus whereby the wearer of said footwear is geographically locatable.

* * * * *